United States Patent [19]

Williams

[11] 4,106,644

[45] Aug. 15, 1978

[54] CLAMPING DEVICES

[75] Inventor: Derek Geoffrey Williams, Sale, England

[73] Assignee: Massey-Ferguson Services N.V., Curacao, Netherlands Antilles

[21] Appl. No.: 720,489

[22] Filed: Sep. 3, 1976

[30] Foreign Application Priority Data

Sep. 3, 1975 [GB] United Kingdom ..... 36360/75

[51] Int. Cl.[2] ..... E02F 3/32

[52] U.S. Cl. ..... 214/138 C; 92/107

[58] Field of Search ..... 214/138 C; 280/456 R; 92/107, 108, 117, 165

[56] References Cited

U.S. PATENT DOCUMENTS

| | | | |
|---|---|---|---|
| 2,703,557 | 3/1955 | Polki | 92/165 R |
| 3,244,301 | 4/1966 | Vaughan | 214/138 C |
| 3,405,823 | 10/1968 | Williams | 214/138 C |
| 3,436,099 | 4/1969 | Long | 214/138 C |
| 3,532,398 | 10/1970 | Vawter | 92/107 |
| 3,665,815 | 5/1972 | McIntier | 92/107 |
| 3,788,674 | 1/1974 | Casey | 214/138 C |
| 3,980,000 | 9/1976 | Iijima et al. | 214/138 C |

FOREIGN PATENT DOCUMENTS

| | | | |
|---|---|---|---|
| 1,368,255 | 9/1974 | United Kingdom | 214/138 C |

*Primary Examiner*—Drayton E. Hoffman
*Assistant Examiner*—Ross Weaver
*Attorney, Agent, or Firm*—Thomas P. Lewandowski

[57] ABSTRACT

Side shift backhoe clamped by two vertical acting and one horizontal clamp. Restrictors allow operation of vertical clamps prior to horizontal to prevent loading of slide rail. Vertical clamp actuators are secured in casting by L-shaped slots which allow actuator to be secured without bolts and allow vertical movement of actuators. Hook on casting takes longitudinal loads and resolves them partially to vertical loads.

30 Claims, 5 Drawing Figures

CLAMPING DEVICES

Figure 1:
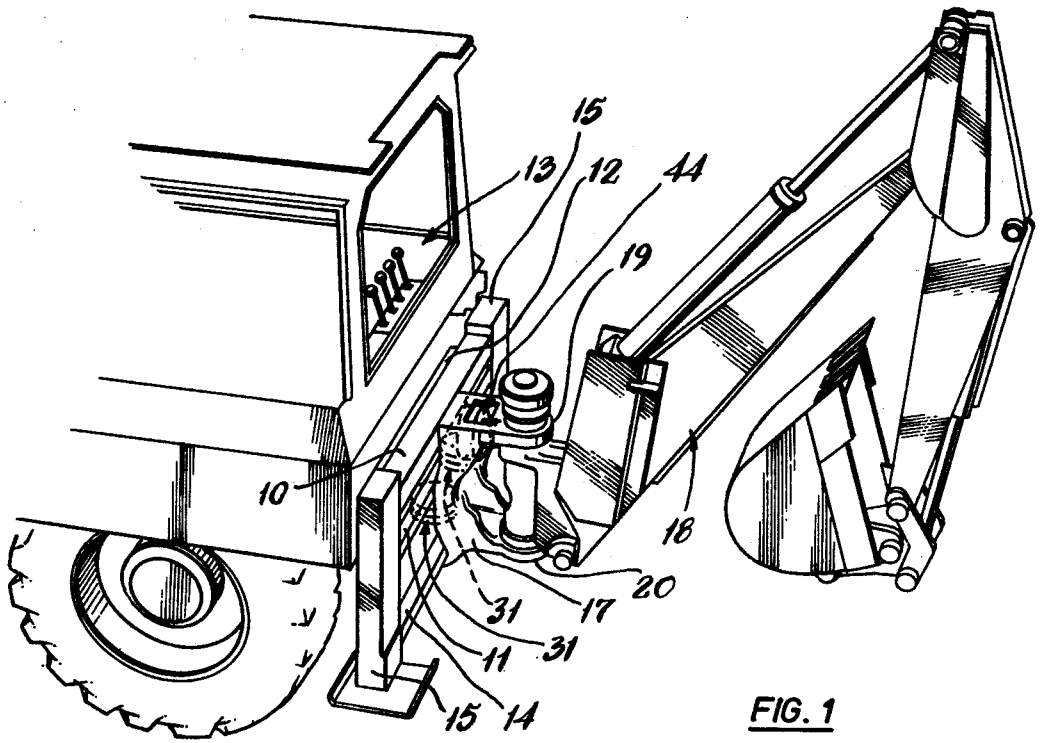

This invention is for improvements in or relating to backhoe assemblies and in particular to assemblies including backhoes arranged to be supported on a frame to be mounted on a vehicle.

Backhoes are known in which a digging boom constituting the main operating member is mounted on a mast for movement relative to a supporting frame secured to a vehicle. In such an arrangement it is provided that the boom can be traversed horizontally relative to the frame for positioning prior to operation, such traversing being known as "offsetting". However effective clamping means must necessarily be provided for clamping the boom relative to the frame prior to operating the backhoe and it is in the provision of suitable clamping means that this invention primarily lies.

There have been previous proposals for providing suitable clamping means for the purpose described but these have suffered from various disadvantages. For example in one arrangement clamping means have been arranged to act vertically on a supporting frame but this has tended to distort the frame when the mast is in a central position.

In a further arrangement the clamping means has acted horizontally but in this case the mast has not been adequately located in the vertical direction and there has been a tendency for the mast to oscillate relative to the frame as the backhoe is operated.

An object of the invention is to obviate at least some of the disadvantages of such prior backhoe support systems.

According to the invention a backhoe assembly comprises a support frame arranged to be attached to a support, for example a vehicle, and including generally horizontal frame members, and an intermediate frame mounted so as to be movable along the frame members, and arranged to support a digging boom, the backhoe assembly further comprising clamping means for clamping the intermediate frame to the support frame said clamping means including a vertically-acting clamp for clamping the intermediate frame to one of the horizontal frame members and a horizontally-acting clamp for clamping the intermediate frame to another of the horizontal frame members.

Preferable the horizontal frame members comprise a pair of upper frame members and a lower frame member and the horizontally-acting clamp acts upon the upper frame members and the vertically-acting clamp acts upon the lower frame member.

Conveniently two vertically-acting clamps are provided in spaced relationship along the lower frame member.

Preferably the vertically-acting clamp is arranged to impart clamping forces to the associated frame member which is reacted in such a way as to generate vertical and horizontal components of the clamping forces to thereby counteract horizontal forces imparted on the intermediate frame during operation.

Preferably also the intermediate frame includes a hook-shaped member having an abutment surface inclined to the vertical and horizontal directions, the abutment surface being arranged to abut a similarly-inclined surface formed on the associated frame member. This arrangement is intended to ensure that minimal bending forces are imparted to the vertical clamp, thereby increasing the useful life of the clamp.

According to a further aspect of the invention a backhoe assembly comprises a support frame, an intermediate frame slidably mounted upon said support frame and arranged to support a backhoe boom, clamping means operable to lock said intermediate frame to said support frame, said clamping means comprising first and second clamps, one of which is operable to cause relative movement between said support frame and said intermediate frame, and control means operable so as to operate said one clamp to cause said movement prior to operation of the other clamp.

According also to the invention there is provided an assembly comprising a frame, a bracket slidably mounted on said frame, clamping means for locking said bracket to said frame, said clamping means including a hydraulic motor having two parts telescopically arranged, one of said parts bearing on said bracket and the other of said parts bearing on said frame, said motor being detachably secured in said assembly by interaction between a lug formed on a first of said parts and a groove formed in a second of said parts, said groove being L-shaped so that said lug may slide along one arm of said L during telescoping and may move along the other arm to remove said motor from said assembly.

Figure 2:
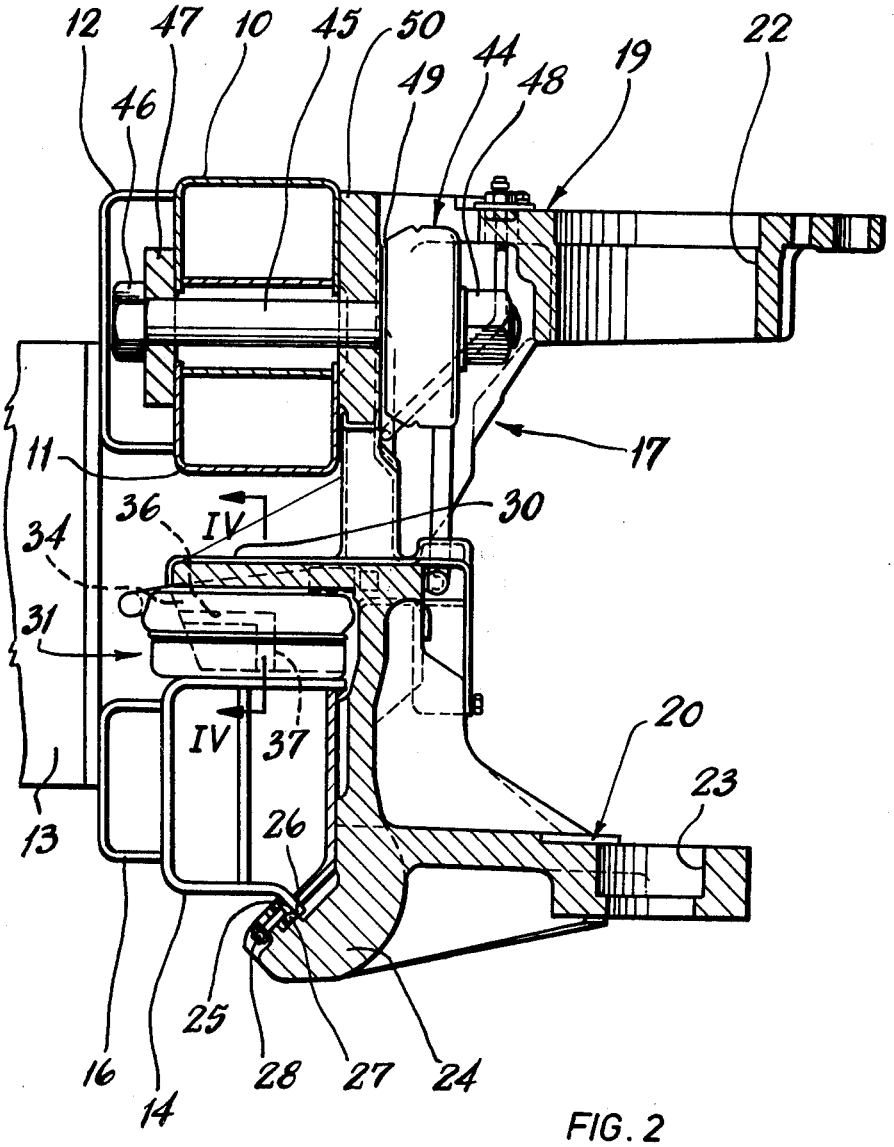
Figure 3:
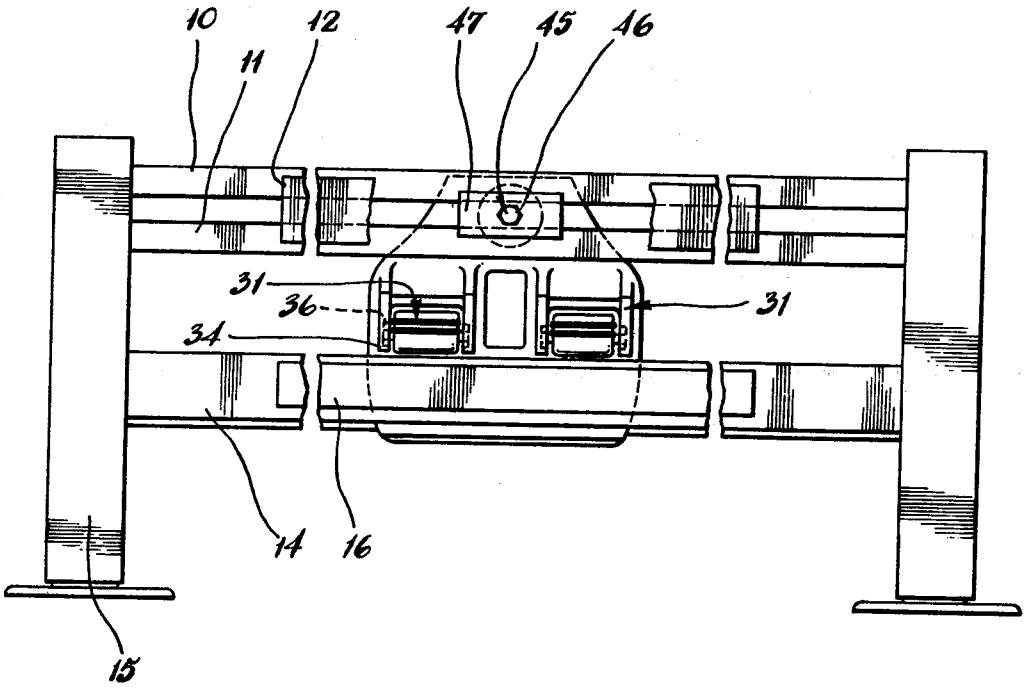
Figure 4:
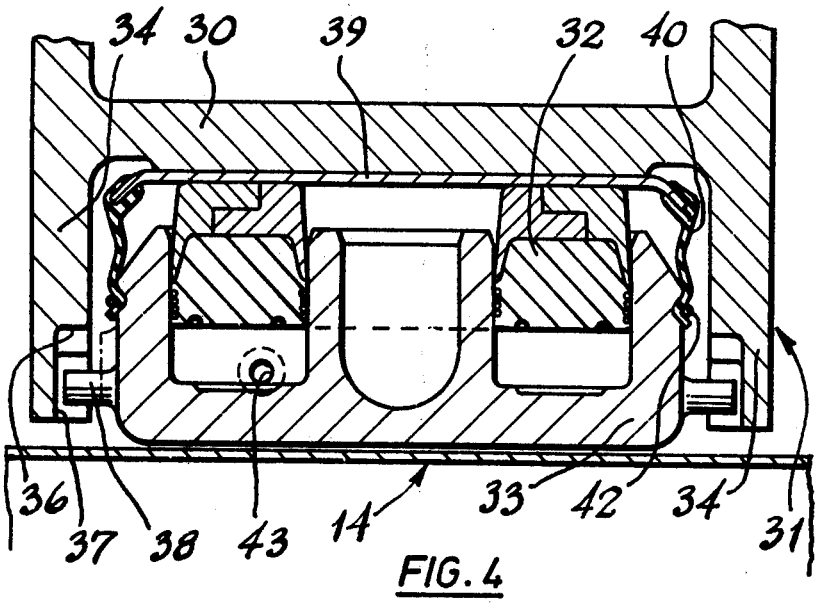
Figure 5:
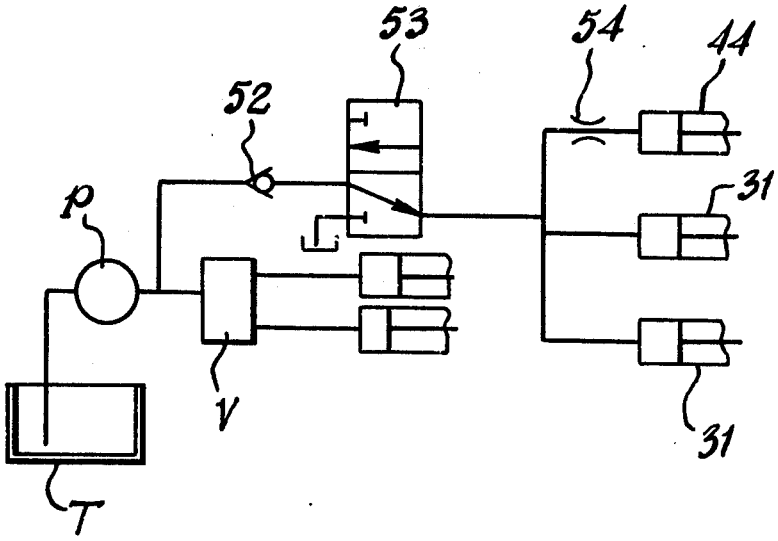

Further features of the invention appear from the following description of an embodiment of the invention given by way of example only and with reference to the accompanying drawings, in which:

FIG. 1 is a schematic perspective view of a backhoe assembly mounted on a vehicle, FIG. 2 is a vertical section through a support frame and an intermediate frame or mast of the assembly of FIG. 1, FIG. 3 is a view in the direction of arrow III in FIG. 2, partly broken away for clarity, FIG. 4 is a view on the line IV—IV of FIG. 2, FIG. 5 is a circuit diagram showing feed of hydraulic fluid to the assembly.

Referring to the drawings, a backhoe assembly includes a pair of upper, parallel, horizontal support frame members 10 and 11 which are spaced apart vertically and which are interconnected at their ends, by stabiliser legs 15. The frame members 10, 11 are enclosed along their forward sides by a bracket 12 and connected rigidly to a support vehicle, in this case a tractor 13 (only part of which is shown in FIG. 1). A lower horizontal support frame member 14 is connected to the stabiliser legs 15 vertically below and parallel to the members 10 and 11 and together the frame members 10, 11 and 14 and the stabiliser legs 15 constitute a support frame whereby the backhoe is attached to the vehicle 13. The frame member 14 is attached to the vehicle by a bracket 16.

Each of the frame members 10, 11 and 14 is generally of box-section and the members extend horizontally the full width of the tractor 13 to an extent sufficient for the backhoe to be traversed horizontally, or "offset", relative to the vehicle.

An intermediate frame or mast 17 is movably mounted on the support frame members 10, 11 and 14, and the mast 17 supports a digging boom 18 (FIG. 1) which may be of known form and does not in itself form part of the present invention.

The mast 17 is movable horizontally along the members 10, 11 and 14 and can be clamped in any selected position along the member by clamping means to be described. The mast 17 includes upper and lower brackets 19 and 20 respectively, each having bores 22 and 23 whose vertical axes are aligned and which are arranged to recieve the boom 18.

Referring to FIG. 2 the lower bracket 20 is formed integrally with a hook-shaped member 24 whose free end forms an abutment surface 25 engaging an inclined surface 26 formed by the lower rearward edge of the lower frame member 14. The surfaces 25 and 26 are equally inclined at about 45 degrees to the horizontal and the surface 25 is formed by a bearing member 27 secured to the hook member 24 by bolts 28.

Intermediate the frame members 10 and 11 the mast 17 is formed with a pair of forwardly directed arms 30 (only one of which is seen in FIG. 2) each of which carries a horizontally-spaced clamp 31 forming part of the clamping means for clamping the mast 17 to the support frame.

The clamps 31 are spaced apart in the direction of the frame member 14 and each includes a piston 32 and cylinder 33 whose common axis is vertical. FIG. 3 shows in more detail one of the clamps 31 and from this can be seen that the cylinder 33 is of annular form with a corresponding annular piston 32. Both the piston and the cylinder are supported from the arm 30 which has a generally U-shaped portion having limbs 34 extending along opposite sides of the cylinder 33. The ends of the limbs 34 are each formed with grooves 36 and 37, the grooves 36 lying parallel with the longitudinal axis of the cylinder and the grooves 37 lying transverse to the grooves 36. The cylinder 33 is formed with laterally-projecting lugs 38 which are arranged to engage in the grooves 36 and 37 to locate the cylinder 33 relative to the arm 30. The lugs 38 and grooves 36 and 37 are arranged in the manner of a bayonet fitting so that to asemble the clamp the piston is inserted fully into the cylinder, and the lugs 38 are entered into the grooves 37, the cylinder is then moved along the groove 37 until the lugs 38 are aligned with the grooves 36 whereupon the cylinder can be extended relative to the piston under the action of hydraulic pressure between the cyliuder and piston. It will be apparent with this arrangement that the piston and cylinder can be extended and retracted with the cylinder being positively located during operation against for and aft movement relative to the arm 30 because when the cylinder is not being extended the limbs 34 abut the frame member 14 to prevent the cylinder being fully retracted and allow the lugs 38 to be aligned with groove 37.

It will also be seen that the end of the piston 32 remote from the cylinder 33 engages a backing plate 39 carried by the arm 30 and a resilient cover 40 is located between the plate 39 and the cylinder 33 and is held in place on the cylinder by a ring 42. Operating fluid is introduced into and discharged from the cylinders 33 through a bore 43 formed in each cylinder.

In operation the cylinders 33 engage the upper wall of the frame member 14 and, when pressurised exert a vertical force on the member 14 which is reacted by cooperation between the hook member 24 and the inclined surface 25. The inclination of the surfaces 25 and 26 resolves the clamping force at these surfaces into a vertical and a horizontal component, the horizontal component acting to counteract the horizontal forces generated when the boom is in use. The forces acting on the cylinder and piston assembly are substantially in the vertical direction thereby preventing undesirable side loading of the seal between the piston and cylinder.

The clamping means also includes a horizontally-acting clamp 44 which is located at the upper end of the mast and clamps the mast to the upper frame member 10 and 11. The clamp 44 is of similar form to the clamps 31 in having an annular piston and cylinder assembly 49 and is located on the mast by a bolt 45 which extends through the piston and mast and between the members 10 and 11. The head 46 of the bolt 45 is located within the bracket 12 and bears on the forward sides of the members 10 and 11 through a plate 47.

The bolt 45 carries a nut 48 at the end remote from the head 46 for locating the piston and cylinder in position. The clamp cylinder 49 engages with an upward extension 50 of the mast which is located between the cylinder 49 and the members 10 and 11 so that an extension of the clamp 44 when fluid power is introduced into the cylinder, the members 10 and 11 are firmly clamped in the horizontal direction between the plate 47 and the extension 50.

It will be apparent that since the operation of the clamp 31 involves some vertical adjustment of the mast relative to the members 10, 11 and 14, the piston 32 and cylinder 33 must be energised before the clamp 44. In order to achieve this the feed of hydraulic fluid to the clamps is controlled by the hydraulic circuit illustrated in FIG. 4.

Referring to FIG. 4, hydraulic fluid is pumped from a tank T by a pump P to provide operating fluid for operating the backhoe through spool valves V and for operating the clamps 31 and 44 through a one-way check valve 52 and a spool valve 53. As shown the spool valve 53 is positioned to direct fluid to the clamps 31 and 44 and a restrictor 54 is located in the line carrying fluid to the clamp 44 so that the clamp 44 does not receive fluid until the clamps 31 are extended and are clamping the support frame. As an alternative to the restrictor 54 the fluid line to the clamp 44 may include two lines in parallel one of which includes a one-way check valve for allowing fluid to be discharged from the clamp cylinder 49 and the other of which includes a spring-controlled check valve which can only open to admit fluid to the clamp cylinder 49 when the pressure in the clamps 31 has reached a level at which any vertical movement of the mast has taken place. The spool valves used may be of the form described in our prior patent specification No. 1136241. The circuit ensures that when the valve 53 is in the clamping position the pressure in the clamp cylinders is constantly topped up by the fluid delivered to the backhoe valve V yet when the valve 53 is moved to disengage the clamps fluid is still available to the backhoes services. It will be appreciated that although there is shown and described an arrangement in which the upper frame member is clamped by a horizontal clamping force and the lower frame member is clamped by a vertical clamping force, the position of the frame members and their associated clamps may be reversed.

Furthermore although the use of a bayonet type connection for the clamp has been described in relation to a backhoe assembly, the connection could fine application in connecting hydraulic clamps or other fluid actuators for other purposes in which the use of bolted connection or the like are impractical or disadvantages.

Similarly the arrangement for the delayed operation of the horizontal cylinder after that of the vertical cylinder can be applied to clamping means other than those described in which it is desirable for one clamp to be operated before another.

What we claim is:

1. A backhoe assembly comprising a support frame arranged to be attached to a support, for example a vehicle, and including generally horizontal frame members spaced apart from each other, an intermediate frame mounted so as to be movable along the frame members and arranged to support a digging boom, the backhoe assembly further including a vertically-acting clamp for clamping the intermediate frame to one of the horizontal frame members and a horizontally-acting clamp for clamping the intermediate frame to another of the horizontal frame members, a housing integral with said intermediate frame, a roof portion of said housing for containing said vertically acting clamp against said one frame member, said roof portion extending outwardly from said intermediate frame and located between said frame members.

2. The backhoe assembly of claim 1 wherein the horizontal frame members comprise a pair of upper frame members and a lower frame member and the horizontally-acting clamp acts upon the upper frame members and the vertically-acting clamp acts upon the lower frame member.

3. The backhoe assembly of claim 2 wherein two vertically-acting clamps are provided in spaced relationship along the lower frame member.

4. The backhoe assembly of claim 2 wherein said vertically acting clamp is located above and acts upon the upper surface of lower frame member.

5. The backhoe assembly of claim 1 wherein the vertically-acting clamp is arranged to impart clamping forces to the associated frame member which is reacted in such a way as to generate vertical and horizontal components of the clamping forces to thereby counteract horizontal forces imparted on the intermediate frame during operation.

6. The backhoe assembly of claim 5 wherein the intermediate frame includes a hook-shaped member having an abutment surface inclined to the vertical and horizontal directions, the abutment surface being arranged to abut a similarly-inclined surface formed on the associated frame member.

7. The backhoe assembly of claim 1 wherein the forces generated by said clamps act on one surface of respective frame members and are opposed by reaction members acting on the opposite surface of said frame members to thereby apply compressive stress to said frame members.

8. The backhoe assembly of claim 7 wherein the horizontal frame members comprise a pair of vertically spaced upper frame members, each of which is of rectangular section and presents a vertical surface against which a portion of said intermediate frame abuts, said horizontally acting clamp acting against said portion of said intermediate frame to force said portion against said vertical surface.

9. The backhoe assembly of claim 8 wherein the force of said horizontally acting clamp is reacted by a plate extending between and abutting the other vertical faces of said upper frame members, said plate and said clamp being interconnected by means of a bolt extending between said upper frame members.

10. The backhoe assembly of claim 9 wherein said clamp is located on the opposite side of said portion of said intermediate frame to said vertical surface and said bolt extends through said intermediate frame.

11. The backhoe assembly of claim 10 wherein said clamp includes a telescopic hydraulic motor comprising an annular piston and an annular cylinder, said bolt passing through the centre of said annulus to threadingly engage a nut which cooperates with said motor, extension of said motor thereby tensioning said bolt to clamp said intermediate frame to said upper frame members.

12. The backhoe assembly of claim 1 wherein the horizontal frame members include a lower frame member presenting horizontal upper surface, said vertically acting clamp acting upon said upper surface to clamp said intermediate frame to said lower frame member.

13. The backhoe assembly of claim 12 wherein the force of said vertically acting clamp is reacted on an under surface of said lower frame member to thereby apply a compressive stress to said lower member.

14. The backhoe assembly of claim 13 wherein said under surface includes an inclined surface and said intermediate frame member has a complimentary inclined surface, said inclined surfaces reacting the force of said vertically acting clamp and resolving said force into vertical and horizontal components.

15. The backhoe assembly of claim 12 wherein said intermediate frame includes a pair of forwardly projecting housings, each housing accommodating a telescopic hydraulic motor and comprising a horizontal roof portion and a pair of side portions depending from said roof portion and extending alongside said motor.

16. The backhoe assembly of claim 15 wherein said housings are positioned above said upper surface and each side portion has a downwardly facing horizontal planar surface to abut said upper surface and support said intermediate frame when said clamps are de-energised.

17. The backhoe assembly of claim 15 wherein said motor is mounted for telescopic movement within said housing along a vertical axis and upstanding guide means are provided on the outer surface of said motor to cooperate with vertical groove in the side portions of said housing to thereby retain said motor within said housing.

18. The backhoe assembly of claim 17 wherein a horizontal groove is provided in each side portion of said housing to intersect said vertical groove, said horizontal groove thereby permitting assembly of said motor into said housing.

19. A backhoe assembly comprising a support frame, an intermediate frame slidably mounted upon said support frame and arranged to support a backhoe boom, clamping means operable to lock said intermediate frame to said support frame, said clamping means comprising first and second clamps, one of which is operable to cause relative movement between said support frame and said intermediate frame in one direction and the other of which is operable to apply a clamping force in another direction, and control means operable so as to operate said one clamp to cause said relative movement prior to operation of the other clamp to clamp in the other direction.

20. A backhoe assembly according to claim 19 wherein said one clamp acts in a vertical direction and said other clamp acts in a horizontal direction.

21. A backhoe assembly according to claim 19 wherein said clamp means include a plurality of hydraulic motors connected in parallel by hydraulic lines to a source of hydraulic fluid and at least one motor is associated with each clamp.

22. A backhoe assembly according to claim 21 wherein the hydraulic line connecting said source to the motor associated with said other clamp includes a restriction to inhibit flow therethrough.

23. A backhoe assembly according to claim 21 wherein a control valve is interposed between said source of pressurised fluid and said motors.

24. A backhoe assembly according to claim 23 wherein said valve is movable between a first position in which flow from the source to said motors is permitted and a second position where flow from said source is prevented and fluid flows from said motor to a sump.

25. A backhoe assembly according to claim 24 wherein a check valve is included between said source and said motor, said check valve preventing flow from said motors when said valve is in said first positon but allowing flow from said motors when said valve is in said second position.

26. An assembly comprising a frame, a bracket slidably mounted on said frame, clamping means for locking said bracket to said frame, said clamping means including a hydraulic motor having two parts telescopically arranged, one of said parts bearing on said bracket and the other of said parts bearing on said frame, said motor being detachably secured in said assembly by interaction between a lug formed on a first of said parts and a groove formed in said bracket, said lug sliding along said groove during telescoping.

27. An assembly according to claim 26 wherein said groove is L-shaped, said lug sliding along one arm of the L during telescoping and along the other arm of the L to remove said motor from said assembly.

28. An assembly according to claim 26 wherein said motor is located with a housing formed integrally with one part of said assembly, said housing comprising a roof portion and a pair of depending side portions, said side portions being formed with an L-shaped groove for receiving said lug and said motor abutting said roof portion to exert a clamping force thereon.

29. An assembly according to claim 28 wherein stop means permit relative movement between said bracket and said frame between a clamped and unclamped condition said stop means thereby assuring that said lug is not aligned with said other arm of the L during normal operation.

30. An assembly according to claim 29 wherein said depending side portions constitute one of said stop means.

* * * * *